US007436388B2

(12) United States Patent
Hillis et al.

(10) Patent No.: US 7,436,388 B2
(45) Date of Patent: Oct. 14, 2008

(54) RAISED DISPLAY APPARATUS

(75) Inventors: William Daniel Hillis, Encino, CA (US); Bran Ferren, Beverly Hills, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 645 days.

(21) Appl. No.: 10/753,995

(22) Filed: Jan. 8, 2004

(65) Prior Publication Data

US 2005/0151761 A1 Jul. 14, 2005

(51) Int. Cl.
*G09G 3/34* (2006.01)

(52) U.S. Cl. ..... 345/108; 40/800

(58) Field of Classification Search ..... 345/108; 434/112–117; 40/800; 340/407.1
See application file for complete search history.

(56) References Cited

U.S. PATENT DOCUMENTS

| | | | | |
|---|---|---|---|---|
| 4,412,799 | A | 11/1983 | Gates | |
| 5,086,287 | A | 2/1992 | Nützel | |
| 5,226,817 | A | 7/1993 | Nakajima et al. | |
| 5,580,251 | A | 12/1996 | Gilkes et al. | |
| 5,718,588 | A | 2/1998 | Tretiakoff et al. | |
| 5,793,918 | A | 8/1998 | Hogan | |
| 5,942,970 | A | 8/1999 | Norman | |
| 6,022,220 | A | 2/2000 | Haugen | |
| 6,109,922 | A * | 8/2000 | Litschel et al. | 434/114 |
| 6,417,821 | B1 | 7/2002 | Becker et al. | |
| 6,535,201 | B1 | 3/2003 | Cooper et al. | |
| 6,903,871 | B2 * | 6/2005 | Page | 359/443 |
| 7,018,209 | B2 * | 3/2006 | Schleppenbach et al. | 434/114 |
| 2003/0117371 | A1 | 6/2003 | Roberts et al. | |
| 2003/0130817 | A1 * | 7/2003 | Page | 702/155 |
| 2004/0029082 | A1 * | 2/2004 | Fournier et al. | 434/112 |
| 2005/0098044 | A1 * | 5/2005 | Spedden | 99/325 |

FOREIGN PATENT DOCUMENTS

| | | |
|---|---|---|
| JP | 11203021 | 7/1999 |
| WO | 02/080134 | 10/2002 |

OTHER PUBLICATIONS

Robert Little, "*Firm Creates Maps on Virtual 'Sand Tables'*", Published Dec. 2, 2002, http://www.sunspot.net/technology/bal-bz.xenotran..., pp. 1-3.

*Xenotran World Class Engineering & Design, Products*, http://www.xenotran.com/products.htm.

Directions Staff, "'*WOW Technology' Found Among the Many Exhibitors at the ESRI User's Conference*", http://www.directionsmag.com/article.php?article_id=641, pp. 1-7.

* cited by examiner

*Primary Examiner*—Richard Hjerpe
*Assistant Examiner*—Tom V Sheng
(74) *Attorney, Agent, or Firm*—Tarolli, Sundheim, Covell & Tummino LLP

(57) ABSTRACT

Systems and methods are provided for displaying raised images. A plate moves along at least one axis of motion. The movement of the plate is operative to adjust respective positions associated with a plurality of pins along the axis of motion. A clutch mechanism operates in conjunction with the plate to position each of the plurality of pins at a desired position along the axis of motion. This deforms a display surface defined by the plurality of pins.

16 Claims, 5 Drawing Sheets

RAISED DISPLAY APPARATUS

TECHNICAL FIELD

The present invention relates to mechanical displays and further to a raised display apparatus.

BACKGROUND OF THE INVENTION

Raised displays provide a compelling method of representing images that are textured or relieved in nature. Generally, such systems employ an array of closely spaced pins, each representing an image element. These pins can be raised to a desired height to form a textured image. The resolution of the display is a function of the density of the pins and the number of positions into which they can be raised. It will be appreciated that the space consumed by an assembly for moving the pins within the device can be a limiting factor on the density of the pins.

In general, raised displays require a substantial amount of time to display an image. In a typical raised display, respective raising mechanisms for each pin, such as a plurality of solenoids, are actuated individually to provide an image. Even a small display can require thousands of pins, making plotting a raised image in this fashion a time-consuming process. A larger, table-sized display can require plotting millions of pins. Individually actuating raising mechanisms for each pin in such a display would be sufficiently time-consuming as to be impractical for most applications.

SUMMARY OF THE INVENTION

In accordance with one aspect of the present invention, a raised display apparatus is provided for displaying raised images. A plate moves along at least one axis of motion. The movement of the plate is operative to adjust respective positions associated with a plurality of pins along the axis of motion. A clutch mechanism operates in conjunction with the plate to position each of the plurality of pins at a desired position along the axis of motion. This deforms a display surface defined by the plurality of pins.

In accordance with another aspect of the present invention, a method is provided for displaying raised images. A plate that supports a plurality of pins is moved to bring all of the pins to a fully extended position. At least one pin is selectively restrained, such that at least one pin is left free. The plate is withdrawn by a predetermined amount as to allow the at least one free pin to retract by the predetermined amount.

In accordance with yet another aspect of the present invention, a method is provided for selectively shifting the positions of a plurality of pins in a raised display. At least one pin that is not at a desired level is selected. While a moving plate is at a first position, a clutch mechanism on a stationary plate is released to allow the at least one pin to move freely. While the plate remains at the first position, a clutch mechanism on the moving plate is engaged, such that the at least one pin is fixed to the moving plate. The moving plate is then moved from the first position to a second position. While the moving plate is at the second position, the clutch mechanism on the moving plate is released. The clutch mechanism on the stationary plate is engaged while the moving plate is at the second position such that the at least one pin is restrained by the stationary plate.

DETAILED DESCRIPTION OF INVENTION

The present invention relates to systems and methods for operating a raised display. The display can comprise a plurality of pins that can be raised to a desired level to produce a desired image. In accordance with an aspect of the invention, the pins are moved by the action of a plate, common to all or a portion of the pins, that can extend and retract along a single axis of motion. A clutch mechanism cooperates with the moving plate to fix the pins at a desired position. In an exemplary embodiment, the display can include a membrane that covers the display and a projector to project an image onto the membrane.

Figure 1:
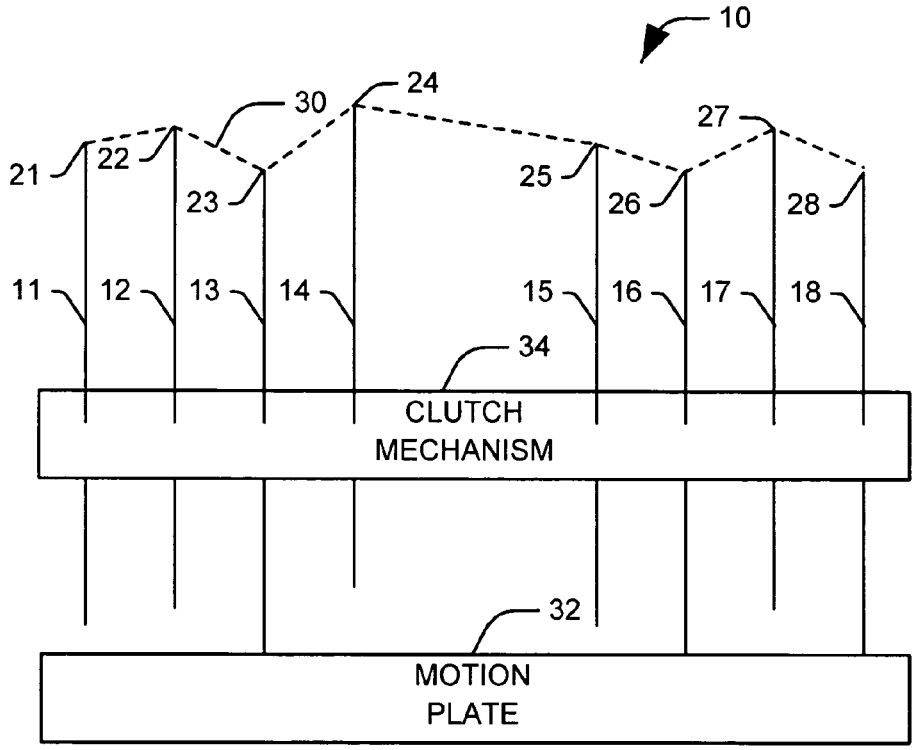
FIG. 1 illustrates a functional diagram of a raised display apparatus in accordance with an aspect of the present invention.

FIG. 1 illustrates a functional diagram of a raised display apparatus 10 in accordance with an aspect of the present invention. The display apparatus 10 comprises a plurality of pins 11-18 arranged in an array such that respective head portions 21-28 associated with the pins collectively define a display surface 30. It will be appreciated that the area of array is not necessarily defined by two Cartesian dimensions. For example, the pins could be arranged along a spherical or hemispherical surface, with the array spanning the azimuthal and polar dimensions across the surface of the sphere.

The position of a given pin (e.g., 11) can be adjusted along an axis of motion. A motion plate 32 can be moved along the axis of motion as to adjust the position of the pins. The motion plate 32 can be moved by reasonable mechanical or electromagnetic means. For example, the plate 32 can be moved via an electrical motor, a hydraulic assembly, or one or more solenoid coils exerting a magnetic force.

A clutch mechanism 34 operates in conjunction with the motion plate 32 to position the plurality of pins. The clutch mechanism 34 is operative to arrest the motion of a given pin at a desired position. The respective positions of the pins can be selected to deform the display surface into a desired raised image. The clutch mechanism can comprise reasonable means for selectively arresting the motion of the pins. For example, the clutch mechanism 34 can comprise components for mechanically or magnetically engaging the pins.

Figure 2:
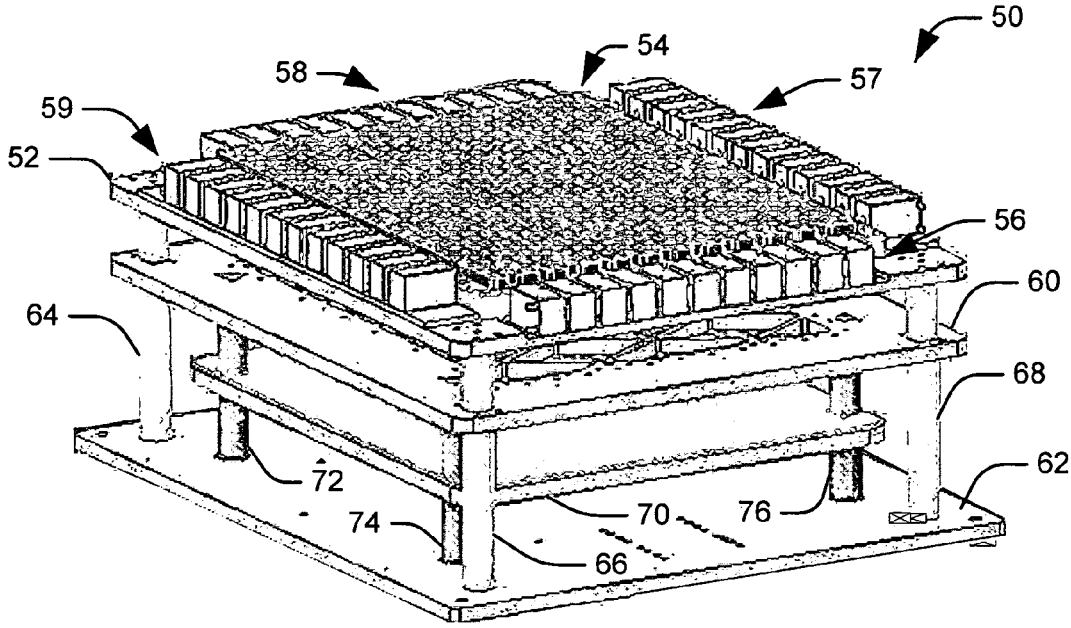
FIG. 2 illustrates a perspective drawing of an exemplary raised display in accordance with an aspect of the present invention.

FIG. 2 illustrates a perspective drawing of an exemplary raised display 50 in accordance with an aspect of the present invention. The illustrated display 50 includes an upper plate 52 that serves a base for the display surface. The upper plate 52 includes a plurality of apertures 54 through which corresponding pins (not shown) comprising the display surface can pass. The pins can include head portions with areas larger than that of their respective apertures, to more fully tessellate the display surface and to help maintain the pins within the apertures.

The upper plate 52 can house part or all of a clutch mechanism that selectively engages one or more pins to maintain the pins at a desired position. In the illustrated display 50, the upper plate 52 houses one or more banks of solenoids 56, 57, 58, and 59. The solenoids 56-59 are operative to shift the position of one or more portions of the clutch (not shown) that physically communicate with the pins. In an exemplary embodiment, the solenoids 56-59 shift the position of one or more bars such that they contact or release circumferential grooves on the surface of the pins.

The display 50 also comprises a lower plate 60 and a base plate 62. The lower plate 60 and the base plate 62 are disposed parallel to the upper plate 52 along one or more support posts 64, 66, and 68. A given support post (e.g., 64) is fixedly mounted to the base plate 62 at a bottom portion and to the upper plate 52 at a top portion. The lower plate 60 is fixedly mounted to each of the support posts (e.g., 64) at a point between the top portion and the bottom portion. In an exemplary embodiment, the lower plate 60 can house a portion of the clutch mechanism.

A lifting plate 70 can be suspended between the lower plate 60 and the base plate 62 on one or more guide posts 72, 74, and 76. The lifting plate 70 can be raised or lowered via a motor and belt system (not shown) to adjust the position of the pins. For example, the pins can be reset to a fully raised position by raising the lifting plate 70 to its maximum height. The movement of the guide pins and the action of the clutch mechanism can be regulated by a display control (not shown). All or part of the display control can be housed on the base plate 62 and the lower plate 60.

Figure 3:
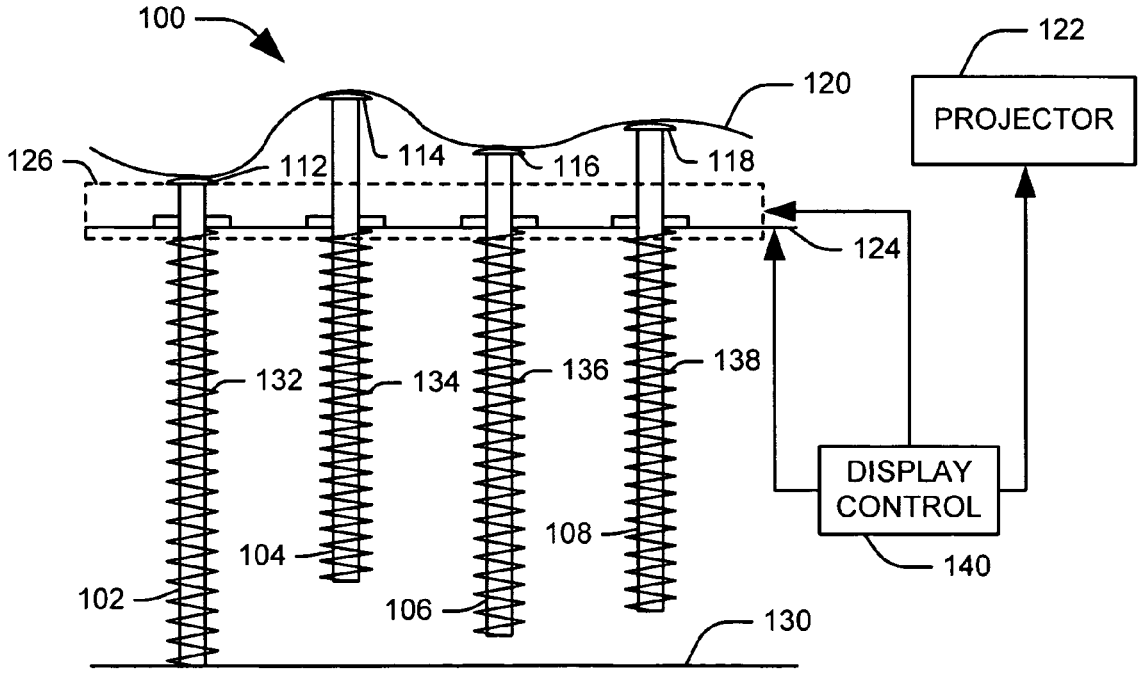
FIG. 3 illustrates a side view of an exemplary raised display in accordance with an aspect of the present invention.

FIG. 3 illustrates a side view of an exemplary raised display 100 in accordance with an aspect of the present invention. The selected view of the display 100 comprises one row of four pins 102-108. It will be appreciated that a functioning display can contain a large number of pins arranged across multiple rows. For example, an exemplary thirty-two square inch display can include around one thousand pins arranged in about twenty rows, depending on the pin diameters and spacing. An exemplary table-sized display can utilize over one million pins in over two hundred rows.

In an exemplary embodiment, the rows containing the pins 102-108 are staggered as to form a honeycomb pattern. Accordingly, the pins 102-108 are arranged in a plurality of linear rows and one or more staggered columns. Alternatively, the pins can be arranged in a Cartesian grid, such that both the rows and the columns are linear. It will be appreciated that other methods of arranging the pins can be utilized, and that the placement of the pins will vary with the necessary size and spacing of the pins, as well as the desired shape (e.g., flat, spherical, recessed) of the array.

In the illustrated display, the pins 102-108 have respective cap portions 112-118 that define a raised surface. The cap portions 112-118 can be covered by an elastic membrane 120 to provide a relatively smooth surface for the display. The use of the pin caps 112-118 and the membrane 120 will depend on the application for which the display is being used. For example, a Braille reader would not require pin caps or a membrane as they would blunt the tactile distinctiveness of the raised pins. The membrane 120 can serve, however, as a backdrop for an image, such as a landscape, projected from a projector 122, allowing the raised display 100 to provide a textured relief map of an area.

The pins 102-108 pass through respective apertures in a stationary, outer plate 124. The outer plate 124 houses a clutch mechanism 126 that acts to maintain the pins in their desired positions. In an exemplary implementation, the clutch mechanism 126 can comprise a series of row bars and column bars having two associated positions. In a first, open, position, a given bar allows the pins within its associated row or column to move freely. In a second, restraining, position, the bar is moved to physically contact the pins at one of a plurality of evenly spaced grooves on the pin, maintaining the pin at its position. The spacing of the grooves corresponds to a desired resolution of the display 100. The position of the bars can be changed via one or more banks of solenoids. In an exemplary embodiment, the bars are biased, by a spring or similar mechanism, to remain in the restraining position, until a solenoid is actuated to move the bar into an open position.

During operation, the pins can be reset into a fully extended position by a reset plate 130. The reset plate 130 can then be incrementally withdrawn to allow the pins 102-108 to retract toward the interior of the display device. In an exemplary embodiment, the reset plate 130 is moved by a motor and belt arrangement (not shown). The pins 102-108 have associated springs 132-138, with each spring (e.g., 132) attached at a first end to the underside of the outer plate 124 and at a second end to the end of the pin (e.g., 102) opposite the cap portion (e.g., 112). When the pins 102-108 are fully extended, the springs 132-138 are compressed against the underside of the outer plate 124. The springs 132-138 thus provide a tensive force on the pins 102-108 as to draw the pins toward the interior of the display device 100.

The movement of the reset plate 130 and the operation of the clutch mechanism can be coordinated by a display control 140 to adjust the position of the pins 102-108. The display control 140 can operatively connected to the projector 122 as well to provide information relating to the desired pin positions to the projector. The reset plate 130 can be incrementally withdrawn toward the interior of the display device 100. In an exemplary embodiment, the reset plate 130 withdraws in increments equal to the spacing between the grooves on the pins 102-108. After each retraction of the plate, the clutch mechanism 126 can be selectively activated to release one or more of the pins, while leaving others secured. The tensive force provided by the springs 132-138 pulls the ends of the released pins flush against the reset plate 130, such that the released pins retract to a uniform level defined by the position of the reset plate. The secured pins remain at their previous level. The pins are then resecured by the clutch mechanism, and the plate is retracted by another increment. This process is repeated as the reset plate 130 retracts to leave each pin at a desired level of extension.

Figure 4:
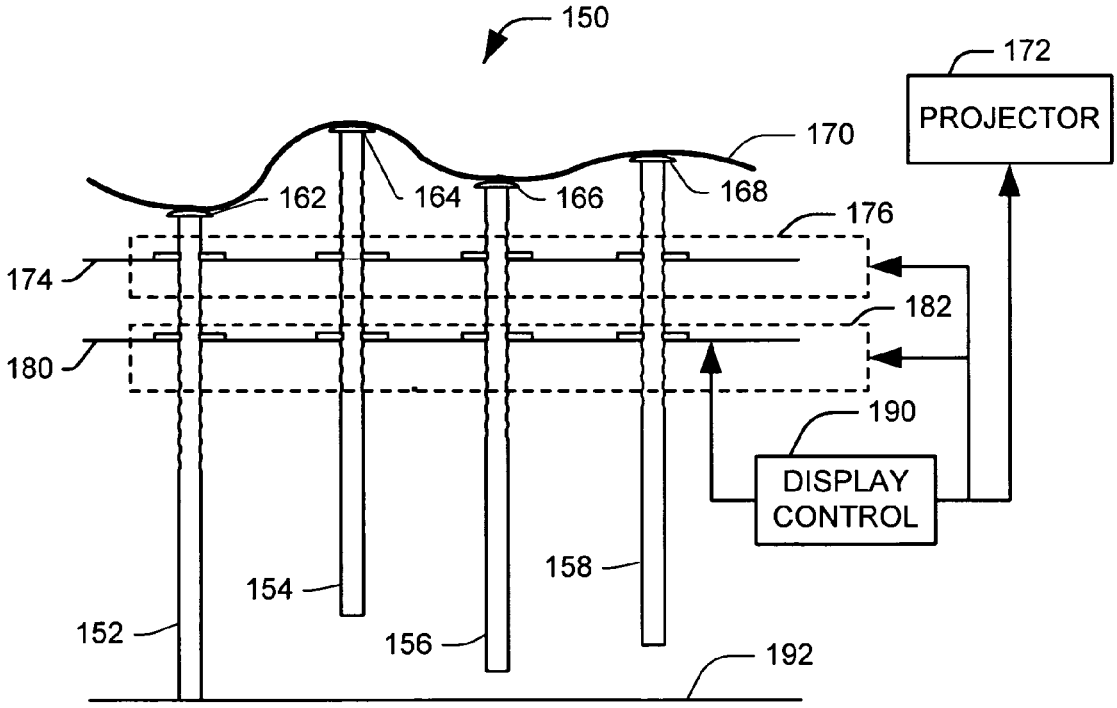
FIG. 4 illustrates a side view of a second exemplary raised display in accordance with an aspect of the present invention.

FIG. 4 illustrates a side view of a second exemplary raised display 150 in accordance with an aspect of the present invention. The selected view of the display 150 comprises one row of four pins 152-158. It will be appreciated that a functioning display can contain a large number of pins arranged across multiple rows. For example, an exemplary thirty-two square inch display can include around one thousand pins arranged in about twenty rows, depending on the pin diameters and spacing. An exemplary table-sized display can utilize over one million pins in over two hundred rows.

In the illustrated display, the pins 152-158 have respective cap portions 152-158 that define a raised surface. The cap portions 162-168 can be covered by an elastic membrane 170 to provide a relatively smooth surface for the display. The use of the pin caps 162-168 and the membrane 170 will depend on the application for which the display is being used. For example, a Braille reader would not require pin caps or a membrane as they would blunt the tactile distinctiveness of the raised pins. The membrane 170 can serve, however, as a backdrop for a projected image, such as a landscape, from a video projector 172 allowing the raised display 150 to provide a textured relief map of an area.

The pins 152-158 pass through respective apertures in a stationary, outer plate 174. The outer plate 174 houses a first portion 176 of a clutch mechanism that acts to adjust the pins 152-158 into desired positions. In an exemplary implementation, the first clutch portion 176 can comprise respective piezoelectric restraints for the plurality of pins. In a default position, a given restraint loops around its associated pin, but allows the pin to move freely. Upon the application of an electrical current, the restraint contracts as to physically contact its associated pin at one of a plurality of evenly spaced grooves on the pin. This fixes the pin to the outer plate 174, maintaining the pin at a stationary position. The spacing of the grooves corresponds to a desired resolution of the display.

The pins 152-158 also pass through respective apertures in a moving plate 180. In an exemplary embodiment, the moving plate 180 is moved by a motor and belt arrangement (not shown). The moving plate 180 houses a second portion 182 of the clutch mechanism. In an exemplary implementation, the second clutch portion 182 can also comprise respective piezoelectric restraints for the plurality of pins. The movement of the moving plate 180 and the operation of the first clutch portion 176 and the second clutch portion 182 can be coordinated by a display control 190 to adjust the position of the pins 152-158. The moving plate 180 oscillates in a direction normal to the outer plate 174 and a base plate 192 between a first position, closest to the base plate and a second position, closest to the outer plate. In an exemplary embodiment, the first position and the second position are separated by a distance equal to the spacing between adjacent grooves.

The plurality of pins 152-158 begin in a default position, fixed to the outer plate 174 by the first clutch portion 176. In an exemplary embodiment, the default position of the pins is a fully withdrawn position (e.g., the first clutch portion 176 engages the uppermost groove of each pin). Since the default position of the pins is known, the display control 190 can determine the distance between the default position and a desired position as a number of increments, as defined by the groove spacing of the pins. The display control 190 can thus select one or more pins (e.g., 154 and 156) to extend by one or more increments. While the moving plate is in its first position, the selected pins are released by the first clutch portion 176. Simultaneously, the second clutch portion 182 engages the selected pins, such that the pins are fixed to the moving plate.

The moving plate 180 can then be moved to its second position. Once the plate reaches the second position, the second clutch portion 182 releases the selected pins, while the first clutch portion 176 reengages the pins. It will be appreciated that the motion of the moving plate 180 can be controlled by the display control 190 such that the first clutch portion 176 can engage the pins at a groove one increment below the default position. Accordingly, the selected pins are extended by one increment. This can be repeated a number of times, to allow one or more pins to be moved to a desired position up to a maximum extension. The final position of each pin will be determined by the number of times the first and second clutch portions 176 and 182 are activated for the pin. This can be controlled by the display control 190 according to the desired position of the pin. Once the pins have been positioned, the display control 190 can direct the projector 172 to project an appropriate image onto the pins.

Figure 5:
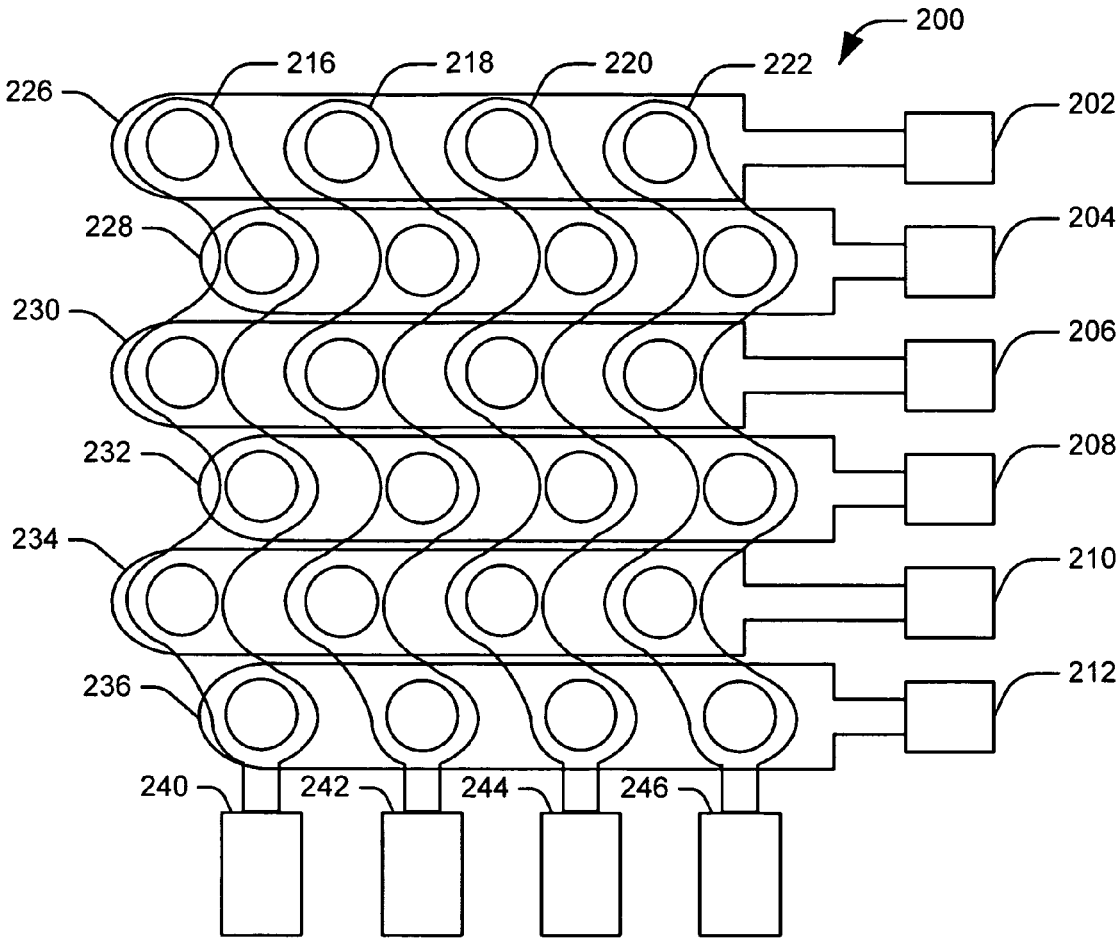
FIG. 5 illustrates a first exemplary clutch mechanism in accordance with an aspect of the present invention.

FIG. 5 illustrates an exemplary clutch mechanism 200 in accordance with an aspect of the present invention. The illustrated clutch mechanism 200 includes six row bars 202-212 and four column bars 216-222. Each of the row bars 202-212 and the column bars 216-222 has an associated spring (not shown) that maintains the bar in a first position. The bars 202-212 and 216-222 also have associated solenoids 226-236 and 240-246 that are operative to pull a given bar (e.g., 202) in the direction of its associated solenoid (e.g., 226) to bring the bar into a second position. A given bar has a plurality of apertures corresponding to the positions of a plurality of pins comprising its associated row of column. Each pin passes through an aperture in one row bar and an aperture in one column bar.

The row bars 202-212 are positioned in parallel along a plane. Each pin has one or more appropriately positioned groove that correspond with the plane of the row bars. In an exemplary embodiment, each groove completely circumscribes its associated pin. The default position for each row bar (e.g., 202) is its first position, in which it physically communicates with the grooves of its associated pins. This holds each pin in its present position regardless of the position of its associated column bar. When a solenoid associated with a given row bar (e.g., 202) is activated, the row bar is pulled into its second position. This releases all of the pins in the row.

The column bars 216-224 are positioned in parallel along a plane spatially removed from the plane of the row bars as to correspond with a series of grooves in the column of pins. Each pin has one or more appropriately positioned groove that correspond with the plane of the row bars. In the illustrated mechanism 200, the rows of the display are staggered, such that the pins of a column do not form a straight line. Consequently, the illustrated column bars are curved in a serpentine pattern as to engage an entire column of pins. Each column bar (e.g., 216) begins in its first position, physically communicating with the grooves of the pins within its associated column. While a column bar (e.g., 216) is in the first position, every pin within the column is immobilized, regardless of whether any row bars have been released. When the solenoid (e.g., 240) associated with the column bar is activated, the column bar assumes a second position, releasing the pins in the column.

The pins can be selectively addressed by sequential operation of the solenoids 226-236 and 240-246 to release one or more selected pins. A solenoid (e.g., 226) associated with a first row bar (e.g., 202) can be activated to release the first row bar. Once the first row bar (e.g., 202) is released, the pins in the first row are held only by their associated column bars. If any of the selected pins are in the first row, their associated column bars (e.g., 218 and 220) can be released via their associated solenoids (e.g., 242 and 244) to completely release the selected pins. The other pins in the affected columns will still be held in place by their associated row bars (e.g., 204-212). The selected pins can be adjusted, and the row bar (e.g., 202) and the selected column bars (e.g., 218 and 220) are then allowed to return to their default positions to resecure the pins. This process can be repeated for each row to release and adjust all of the selected pins.

Figure 6:
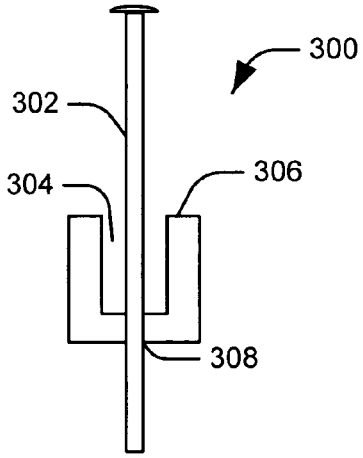
FIG. 6 illustrates a second exemplary clutch mechanism in accordance with an aspect of the present invention.

FIG. 6 illustrates a second exemplary clutch mechanism 300 in accordance with an aspect of the present invention. A pin 302 can be encased in a solid restraining material 304 having a low melting point. For example, the restraining material can be an alloy of lead and one or more other metals. The restraining material 304 is contained in a container 306 having a relatively high melting point. The container includes an aperture 308 through which the pin 302 passes. The aperture 308 is sized to closely match the diameter of the pin 302.

The clutch mechanism 300 disengages by applying heat from a heat source to the restraining material 304 in order to bring it to a liquid state. The heat source can be applied by a laser apparatus (not shown) directed on the restraining material 304 or by a heating element associated with the container 306. In an exemplary implementation, the container is the heat source, producing resistive heat upon the application of an electrical current. While the restraining material 304 is in a liquid state, the pin 302 can move freely through the aperture 308. Once the heat source is deactivated, the restraining material 304 cools and returns to a solid state, restraining the pin.

Figure 7:
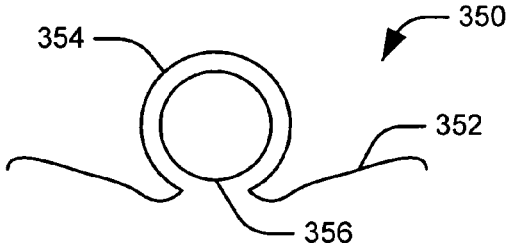
FIG. 7 illustrates a third exemplary clutch mechanism in accordance with an aspect of the present invention.

FIG. 7 illustrates a third exemplary clutch mechanism 350 in accordance with an aspect of the present invention. The clutch mechanism 350 includes a wire 352, having shape memory properties, with a loop 354 situated around a pin 356. A material with shape memory properties has the ability to return to an imprinted shape when heated. A desired shape can be imprinted into the material by molding the material at a high temperature and maintaining the desired shape as it cools. Below a threshold temperature, the material is relatively flexible and can be deformed away from the imprinted shape with relative ease. Once the material is heated above the threshold temperature, however, it reverts back to the imprinted shape with some force. In an exemplary implementation, the wire is a formed from nitinol, an alloy of nickel and titanium.

The wire 352 is imprinted with a shape in which its loop 354 is closed with a diameter slightly smaller than that of the pin 356. The wire 352 is ordinarily maintained at a temperature lower than its threshold temperature. It will be appreciated that an appropriate shape memory material can be selected that has a threshold temperature above room temperature. While below its threshold temperature, the wire 352 can be deformed by a tensive force on either end of the wire to assume a desired shape. Specifically, the wire 352 is shaped such that the loop 356 is opened around the pin 356. Accordingly, the pin can move freely through the loop 356.

A current can be applied to the wire 352 to heat the wire via resistive heating to a temperature greater than its threshold temperature. This causes the wire to return to its imprinted shape, engaging the pin as the loop 356 closes. The wire 352 returns to its imprinted shape somewhat forcefully, such that the tensive force on the ends of the wire is insufficient to restrain it. In an exemplary embodiment, the wire 352 is looped around a groove in the surface of the pin to facilitate engagement of the pin. When the current is no longer applied, the wire 352 cools and returns to its more malleable state. Once the wire 352 cools below threshold, the tensive force applied can once again deform the wire into an open shape, releasing the pin.

Figure 8:
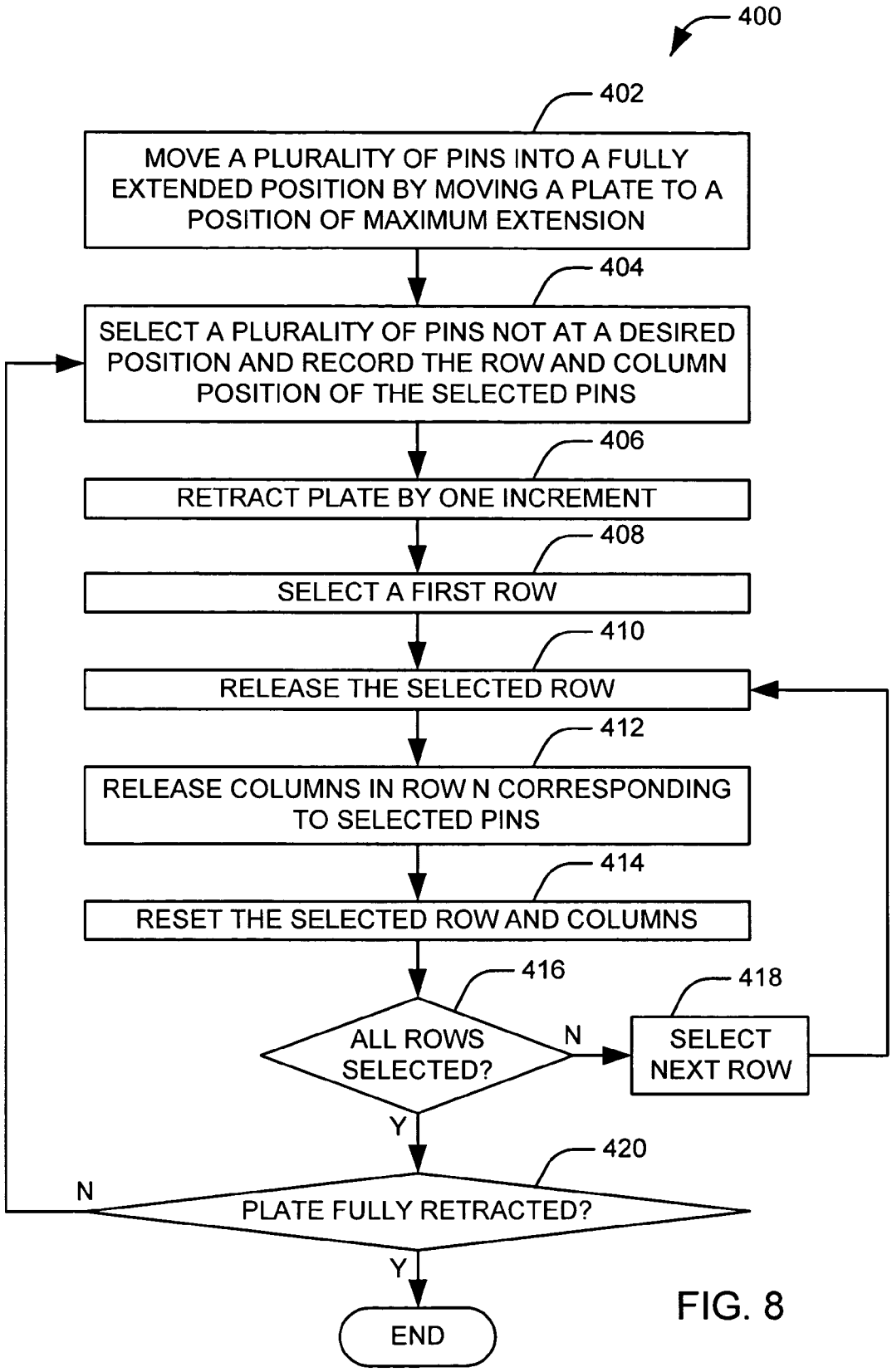
FIG. 8 illustrates an exemplary methodology for displaying a raised image in accordance with an aspect of the present invention.
Figure 9:
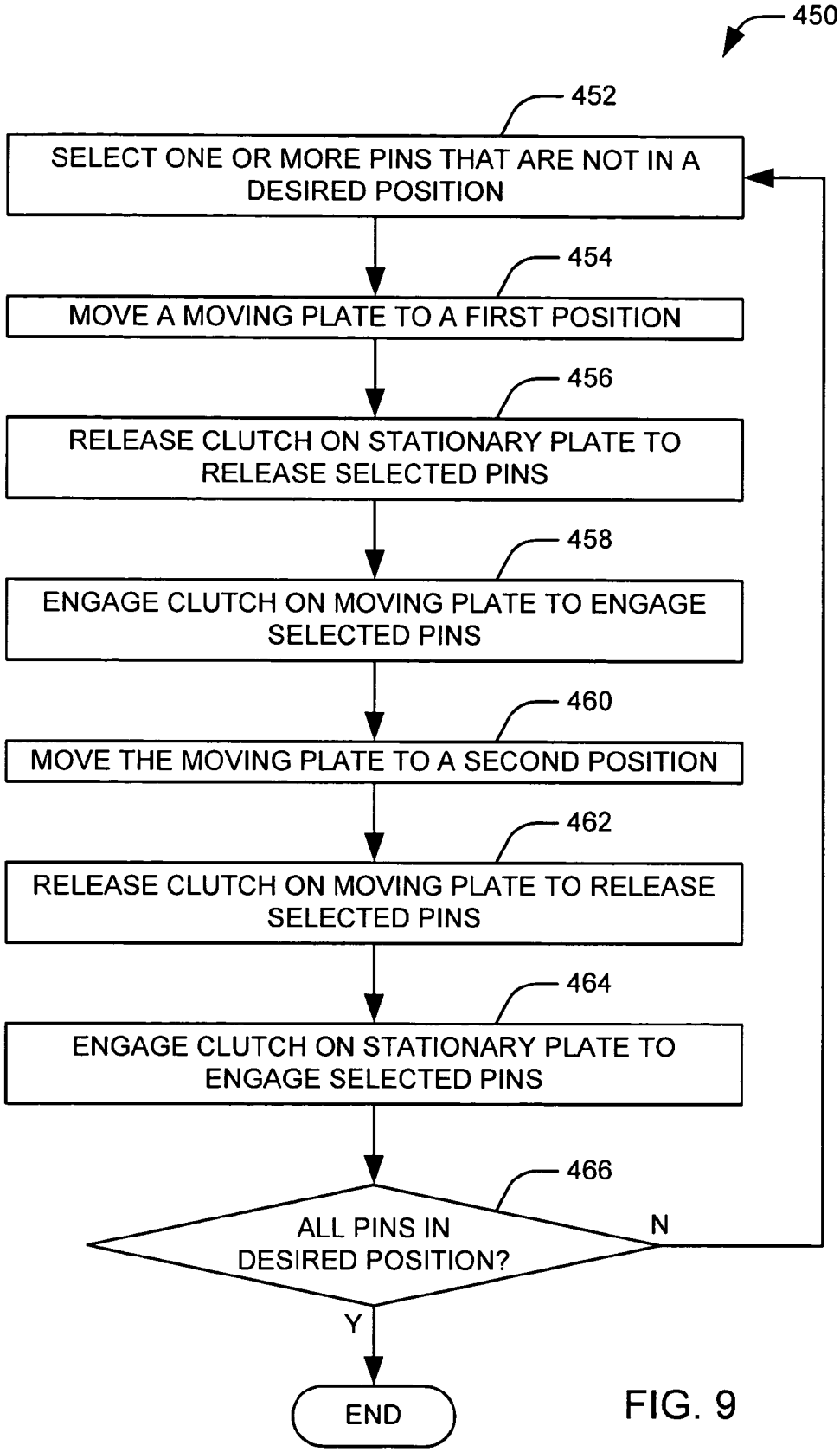
FIG. 9 illustrates an exemplary methodology for selectively adjusting the position of one or more of a plurality of pins in a raised display in accordance with an aspect of the present invention.

In view of the foregoing structural and functional features described above, methodologies in accordance with various aspects of the present invention will be better appreciated with reference to FIGS. 8-9. While, for purposes of simplicity of explanation, the methodologies of FIGS. 8-9 are shown and described as executing serially, it is to be understood and appreciated that the present invention is not limited by the illustrated order, as some aspects could, in accordance with the present invention, occur in different orders and/or concurrently with other aspects from that shown and described herein. Moreover, not all illustrated features may be required to implement a methodology in accordance with an aspect the present invention.

FIG. 8 illustrates an exemplary methodology 400 for displaying a raised image in accordance with an aspect of the present invention. At 402, a plurality of pins are moved into a fully extended position. In an exemplary implementation, this can be accomplished by moving a plate to a position of maximum extension. The pins are pushed to their fully extended position by the action of the plate. At 404, a plurality of pins that are not at respective desired positions are selected. The row and column position of the selected pins are recorded by a display control.

At 406, the plate is retracted by a predetermined distance. Each retraction of the plate covers an equal distance such that the plate retracts in a series of constant increments until a position of maximum withdrawal is reached. The size of the increments will depend on a desired resolution of the raised display. In an exemplary embodiment, an increment is one-eighth of an inch, but the size of an increment will vary with the application. At 408, a first row is selected. At 410, a clutch mechanism associated with the selected row is released. Each pin is addressed by two clutch mechanisms, one associated with the row position of pin and one associated with the column position of the pin. Thus, the release of the clutch mechanism associated with the selected row does not fully release any pins.

The selected row can contain one or more of the selected pins, and the column positions of the selected pins within the row will be known at the display control. Accordingly at 412, one or more clutch mechanisms associated with the columns represented by the selected pins within the row can be released to free the selected pins. The selected pins will be drawn toward the retracted plate, causing them to withdraw such that the ends of the pins are flush with the surface of the plate. This can be accomplished, for example, by gravity or by an elastic binding between the pin and the plate. In an exemplary embodiment, the pins have associated springs that are compressed between the end of the pin and the display surface to force the pin toward the moving plate. The pins will thus be retracted to a uniform level one increment beneath the pins that remained secured. The other pins in the selected columns will be restrained by the clutch mechanisms associated with their respective rows. Likewise, the other pins within the selected row will be restrained by the clutch mechanisms associated with their columns. Accordingly, only the selected pins within the row will shift position.

The methodology 400 continues at 414, where the selected row and columns are reset to restrain the selected pins. At 416, it is determined if all of the rows have been selected. If rows remain that have not been selected, the next row in sequence is selected at 418. The methodology 400 then returns to 410 to adjust the positions of the selected pins within the selected row. If all of the rows have been selected, the methodology 400 proceeds to 420. At 420, it is determined if the plate is fully retracted. If the plate is not fully retracted, the methodology returns to 404 to select a new set of pins that require adjustment. If the plate is fully retracted, all pins have been adjusted to their desired position and the methodology 400 terminates.

FIG. 9 illustrates an exemplary methodology 450 for selectively adjusting the position of one or more of a plurality of pins in a raised display in accordance with an aspect of the present invention. At 452, one or more pins are selected that are not in a desired position. A display control can determine a distance between the pin and its desired position and the necessary direction as a number of increments, an increment corresponding to a uniform spacing between grooves on the plurality of pins. For the purpose of example, the illustrated methodology assumes that the pins begin at a default, fully retracted position and are extended incrementally to their respective desired positions. It will be appreciated that the methodology 450 can operate in the opposite direction to withdraw extended pins or to move pins in both directions.

At 454, a moving plate is moved to a first position. In an exemplary implementation, the first position corresponds to a retracted position of the plate. A second position corresponds to an extended position of the plate. The distance between the first position and the second position corresponds to the spacing between adjacent grooves on the plurality of pins. At 456, a first clutch mechanism associated with a stationary plate is released on the selected pins. This allows the selected pins to move freely, while the non-selected pins remain restrained relative to the stationary plate. At 458, a second clutch mechanism associated with the moving plate engages the selected pins. This operates to fix the selected pins to the moving plate. In an exemplary embodiment, the engaging of the second clutch mechanism is timed to occur simultaneously with the release of the first clutch mechanism.

At 460, the moving plate is moved to the second position. The selected pins are moved along with the plate to a position one increment above their previous position. At 462, the second clutch is released for the selected pins, freeing the selected pins from the moving plate. At 464, the first clutch is engaged for the selected pins, restraining the selected pins at their new position. In an exemplary embodiment, the engaging of the first clutch mechanism is timed to occur simultaneously with the release of the second clutch mechanism.

The methodology then proceeds to 466, where it is determined if all pins are in their desired position. The position of a given pin can be determined by recording the number of times a given pin has been engaged and released by the second clutch mechanism. If pins remain that are not in their desired position, the process returns to 452 to select one or more pins for adjustment. If all pins are positioned correctly, the methodology 450 terminates.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A display assembly for displaying raised images comprising:

a plate that moves along at least one axis of motion, the movement of the plate being operative to adjust respective positions associated with a plurality of pins along the axis of motion; and a clutch mechanism comprising a plurality of rigid row bars and a plurality of rigid column bars, a given rigid row bar being operative to restrain a row of pins when the given rigid row bar is positioned in an associated first position and to release the row of pins when the rigid row bar is positioned in an associated second position and a given rigid column bar being operative to restrain a column of pins when the rigid column bar is positioned in an associated first position and to release the column of pins when the rigid column bar is in an associated second position, the clutch mechanism operating in conjunction with the plate to position each of the plurality of pins at a desired position along the axis of motion as to deform a display surface defined by the plurality of pins.

2. The assembly of claim 1, the clutch mechanism further comprising at least one bank of solenoids, a given solenoid being operative to move one of a rigid row bar and a rigid column bar from its associated first position to its associated second position.

3. The assembly of claim 1, further comprising a display control that coordinates the movement of the plate and the operation of the clutch mechanism.

4. The assembly of claim 1, further comprising a membrane that covers the plurality of pins, such that the membrane is distorted by the movement of the pins.

5. The assembly of claim 1, further comprising a projector that projects an image onto the display surface.

6. The assembly of claim 1, the plate being a first plate and the assembly further comprising a second, stationary plate.

7. The assembly of claim 6, a first portion of the clutch mechanism being located on the first plate, the first portion of the clutch mechanism being operative to fix at least one pin to the first plate, and a second portion of the clutch mechanism being located on the second plate, the second portion of clutch mechanism being operative to hold the at least one pin stationary with respect to the second plate.

8. The assembly of claim 1, the plate being operative to oscillate between a first position and a second position, the clutch mechanism being operative to fix at least one pin to the plate when the plate is at a first position and hold the at least one pin stationary when the plate is in a second position.

9. The assembly of claim 1, wherein the plurality of rigid row bars and the plurality of rigid column bars each comprises a plurality of apertures, a given pin passing through one aperture in the given rigid row bar and one aperture in the given rigid column bar.

10. The assembly of claim 9, wherein each of the plurality of pins comprises a plurality of circumferential grooves that define a resolution of the display, wherein a first circumferential groove of the given pin engages the one aperture of the given rigid row bar when the given rigid row bar is in the associated first position, and a second circumferential groove of the given pin engages the one aperture of the given rigid column bar when the given rigid column bar is in the associated first position.

11. The assembly of claim 1, the plurality of rigid column bars having a substantially serpentine pattern.

12. A method of selectively shifting the positions of at least one of a plurality of pins in a raised display comprising:

selecting at least one pin that is not at a desired level;

releasing a clutch mechanism on a stationary plate while a moving plate is at a first position to allow the at least one pin to move freely;

engaging a clutch mechanism on the moving plate while the moving plate is at a first position such that the at least one pin is fixed to the moving plate;

moving the moving plate from the first position to a second position;

releasing the clutch mechanism on the moving plate while the moving plate is at the second position; and engaging a clutch mechanism on the stationary plate while the moving plate is at the second position such that the at least one pin is restrained by the stationary plate.

13. The method of claim 12, engaging a clutch mechanism on the stationary plate comprising providing an electrical current to at least one restraining wire having shape memory properties.

14. The method of claim 12, engaging a clutch mechanism on the stationary plate comprising deactivating a heating element as to cause a restraining material to assume a solid state.

15. The method of claim 14, wherein at least a portion of the at least one pin is submerged in the restraining material.

16. A raised display apparatus comprising:

means for moving a plurality of pins along an axis of motion;

means for restraining at least one of a row and a column of the plurality of pins at a plurality of locations along the axis of motion;

means, associated with each of the plurality of pins, for engaging the means for restraining at predetermined intervals along the axis of motion;

means for selecting a row and column of at least one selected pin; and means for releasing the means for restraining of the selected row and column of the at least one selected pin;

wherein the means for moving comprises a means for engaging at least one pin as to fix the engaged pins to the means for moving.

* * * * *